US009380824B2

(12) United States Patent
Ma et al.

(10) Patent No.: US 9,380,824 B2
(45) Date of Patent: Jul. 5, 2016

(54) ADJUSTABLE HELMET AND HEAD MASSAGER

(75) Inventors: Xuejun Ma, Shenzhen (CN); Yong Wan, Shenzhen (CN)

(73) Assignee: SHENZHEN BREO TECHNOLOGY CO., LTD., Shenzhen (CN)

( * ) Notice: Subject to any disclaimer, the term of this patent is extended or adjusted under 35 U.S.C. 154(b) by 981 days.

(21) Appl. No.: 13/522,406

(22) PCT Filed: Jan. 31, 2011

(86) PCT No.: PCT/CN2011/070861

§ 371 (c)(1), (2), (4) Date: Jul. 16, 2012

(87) PCT Pub. No.: WO2012/071802

PCT Pub. Date: Jun. 7, 2012

(65) Prior Publication Data

US 2012/0296245 A1 Nov. 22, 2012

(30) Foreign Application Priority Data

Nov. 29, 2010 (CN) ..... 2010 2 0630038 U

(51) Int. Cl.
*A61H 7/00* (2006.01)
*A42B 3/14* (2006.01)

(52) U.S. Cl.
CPC ..... *A42B 3/145* (2013.01); *A61H 7/006* (2013.01)

(58) Field of Classification Search
CPC ..... A42B 1/22; A42B 3/14; A42B 3/142; A42B 3/145; A42B 3/147; A61H 7/006; F16H 2007/0853; F16H 2007/0855; A43C 11/146; A43C 11/1466; A43C 11/1473; A43C 11/148; A44B 11/065
USPC ..... 24/20 TT; 248/292.12; 2/417, 418, 420
See application file for complete search history.

(56) References Cited

U.S. PATENT DOCUMENTS 3,214,809 A * 11/1965 Edwards ..... 24/68 B
5,421,799 A * 6/1995 Rabin et al. ..... 601/71
7,174,575 B1 2/2007 Scherer (Continued)

FOREIGN PATENT DOCUMENTS

CN 2933054 8/2007
CN 201578546 9/2010
CN 101919782 12/2010

*Primary Examiner* — Justine Yu
*Assistant Examiner* — Michael Tsai
(74) *Attorney, Agent, or Firm* — Hamre, Schumann, Mueller & Larson, P.C.

(57) ABSTRACT

An adjustable helmet and a head massager are provided. The adjustable helmet comprises a ring-shaped latitudinal shell and a longitudinal shell connected across the latitudinal shell, at least one of the longitudinal shell and the latitudinal shell has an adjustable means, the inside of the adjustable means has a bidirectional locking structure. In the embodiments, the adjustable means has a bidirectional locking structure which can lock the latitudinal shell or longitudinal shell in bi-direction. When the latitudinal shell or longitudinal shell is disengaged or contracted by the adjustable means and is locked by the bidirectional locking structure, the latitudinal shell or longitudinal shell is fixed in the expanding direction or contracting direction and can't continue to be expanded or contracted inwards. Advantageously, the helmet in use has a constant size, which is useful for users, when the above-mentioned adjustable helmet is applied to a head massager, it's convenient for massage.

20 Claims, 6 Drawing Sheets

(56) References Cited

U.S. PATENT DOCUMENTS 7,565,704 B2 7/2009 Wu
8,015,625 B2 * 9/2011 Grim et al. ..... 2/420
2010/0050325 A1 3/2010 Wang-Lee
2010/0095438 A1 4/2010 Moelker
2011/0167543 A1 * 7/2011 Kovacevich et al. ..... 2/417

* cited by examiner

ADJUSTABLE HELMET AND HEAD MASSAGER

BACKGROUND OF THE INVENTION

1. Technical Field

The present invention relates to a health massage apparatus, and more particularly, to an adjustable helmet and a head massager.

2. Description of Related Art

A head massager is used for massaging user's head, usually including a helmet and a massager means. When the head massager is used, a person puts the helmet on his head and uses the massage means mounted on the helmet to massage his head. In order to adapt to the users' heads having a variety of sizes, the helmet is generally adjustable. This adjustable helmet includes a longitudinal shell and a latitudinal shell. The longitudinal shell and latitudinal shell respectively have adjustable means whose length can be adjusted. However, the existing adjustable means only have a unidirectional locking structure in which the longitudinal shell and latitudinal shell is disengaged and locked on a contracting direction so that the helmet can not be further reduced, and the helmet is not fixed in a expanding direction. The longitudinal shell and latitudinal shell can continue to be expanded. As a result, there is much inconvenience when the unidirectional locking helmet is used.

BRIEF SUMMARY OF THE INVENTION

A technical problem to be solved by the present invention is to overcome the shortcomings of the prior art and provide a helmet having a simple structure which has a bidirectional locking means and a head massager thereof.

The present invention adopts the following technical solutions to solve the technical problem: providing an adjustable helmet comprising a ring-shaped latitudinal shell and a longitudinal shell connected across the latitudinal shell, at least one of the longitudinal shell and the latitudinal shell has an adjustable means which is able to adjust the length of the shell, the inside of the adjusting means has a bidirectional locking structure.

In particular, the bidirectional locking structure comprises a ratchet wheel and a ratchet wheel base engaged with the ratchet.

In particular, the ratchet wheel comprises an upper ratchet buckle and a lower ratchet buckle having an opposite direction to that of the upper ratchet buckle, the ratchet wheel base is disposed around the ratchet wheel, the ratchet wheel base has an upper ratchet ring and a lower ratchet ring respectively matched with the upper ratchet buckle and the lower ratchet buckle.

Further, the ratchet wheel comprises a body, the upper ratchet buckle and the lower ratchet buckle are symmetrically provided along a radial direction of the body, furthermore, the upper ratchet buckle and the lower ratchet buckle are provided one by one along a axial direction of the body, two symmetrical first installation slots mounted on the same circle are respectively defined in the upper ratchet buckle and the lower ratchet buckle, an inside of a knob has two first fixing posts respectively located in the two first installation slots.

Further, a second fixing posts is formed on the lower ratchet buckle in a radial direction of the body, the second fixing posts resist against an edge of the upper ratchet buckle, the inside of the knob correspondingly has a second installation slots for the second fixing posts being slided therein when the second fixing posts are rotated.

Furthermore, the outside edge of the upper ratchet buckle has a first protrusion, an outside edge of the lower ratchet buckle has a second protrusion, both of the inside surfaces of the first protrusion and the second protrusion along the circumferential direction of the ratchet wheel are right angle surfaces and the outside surfaces of the first protrusion and the second protrusion along the circumferential direction of the ratchet wheel are a circle-arc surface.

Furthermore, there are hollow gaps between the ratchet buckle, the ratchet buckle and the body, and the gaps are curve-shaped.

In particular, the adjustable means comprises a fixing shell outside of the latitudinal shell or longitudinal shell, a knob installed on the fixing shell and an adjustable block installed on the latitudinal shell or longitudinal shell, the ratchet wheel is fixed on an inside of the knob and the adjustable block is fixed on an inside of the ratchet wheel.

In particular, at least one of the latitudinal shell or longitudinal shell has a first groove and a second groove overlapped each other, an upper edge of the first groove has an upper rack, a lower edge of the second groove has a lower rack, the adjustable block is a gear which is extended through the first groove and the second groove, and engages with the upper rack and the lower rack respectively.

The present invention also provides a massage comprising a helmet and a massage mounted on the helmet, the helmet is the above-mentioned adjusting helmet.

In the embodiments of the present invention, the adjustable means has a bidirectional locking structure, the latitudinal shell or longitudinal shell with adjustable length can be locked by the bidirectional locking structure. When the latitudinal shell or longitudinal shell is disengaged by the adjustable means and is locked by the bidirectional locking structure, the latitudinal shell or longitudinal shell is fixed in the expanding direction or contracting direction and can't continue to expand or contract inwards. When the latitudinal shell or longitudinal shell is contracted by the adjustable means and is locked by the bidirectional locking structure, the latitudinal shell or longitudinal shell is fixed in the expanding direction or contracting direction and can't continue to be contracted or expanded inwards. Advantageously, the helmet in use has a constant size, which is useful for users, when the above-mentioned adjustable helmet is applied to a head massager, it is convenient for massage.

DETAILED DESCRIPTION OF THE INVENTION

In order to make clearer the objects, technical solutions and advantages of the invention, the present invention will be explained below in detail with reference to the accompanying drawings and embodiments. It is to be understood that the following description of the embodiments is merely to explain the present invention and is no way intended to limit the invention.

The adjustable helmet in the present invention includes a ring-shaped latitudinal shell and a longitudinal shell connected across the latitudinal shell, at least one of the longitudinal shell and the latitudinal shell has an adjustable means which is able to adjust a length the shell, an inside of the adjustable means has a bidirectional locking structure.

In the present invention, the adjustable means has a bidirectional locking structure, the latitudinal shell or longitudinal shell having an adjustable length can be locked by the bidirectional locking structure. When the latitudinal shell or longitudinal shell is disengaged using the adjusting means and is fixed by the bidirectional locking structure, the latitudinal shell or the longitudinal shell is fixed in an expanding direction and a contracting direction which can't continue to expand or contract inwards. When the latitudinal shell or longitudinal shell is contracted using adjusting means and is locked by the bidirectional locking structure, the latitudinal shell or the longitudinal shell is fixed in the expanding direction and the contracting direction which can't continue to contract or expand outwards. Advantageously, the helmet in use has a constant size which is convenient for users, when the adjustable helmet is applied to a head massager, the head massage is more convenient.

In the present invention, the bidirectional locking structure may be ratchet wheels engaged with each other and a ratchet base. The bidirectional locking structure also may be rotating plate having symmetrical locking pieces and the matching rotary plate base or other locking structures.

Referring to the accompanying figures, the following describes the bidirectional locking structure in detail which includes the ratchet wheels engaged with each other and the corresponding ratchet wheel base.

Figure 1:
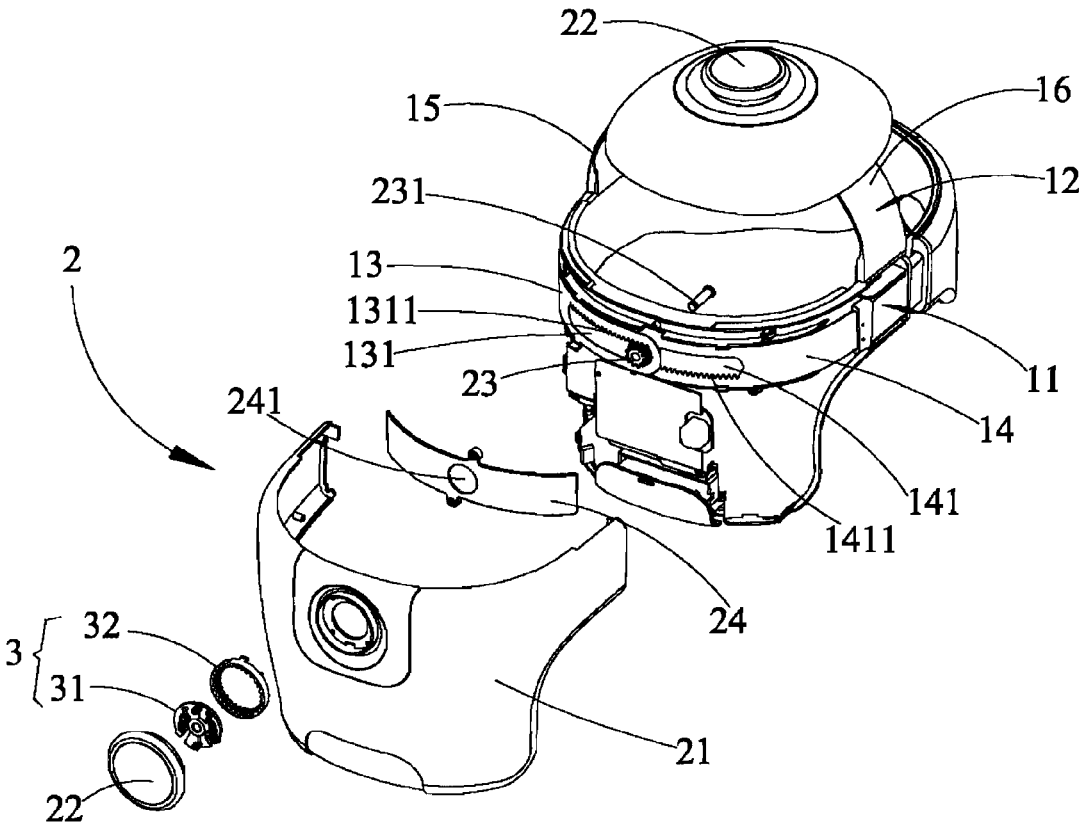
FIG. 1 is a schematic perspective exploded view of one preferred embodiment of the adjustable helmet according to the present invention.

FIG. 1 is a schematic perspective exploded view of the adjustable helmet 1 according to one preferred embodiment of the present invention. The adjustable helmet 1 includes a ring-shaped latitudinal shell 11 and a longitudinal shell 12 connected across the latitudinal shell 11, at least one of the latitudinal shell 11 and the longitudinal shell 12 is jointed by two shells which are movable towards each other. In this embodiment, the latitudinal shell 11 is joined by a first shell 13 and a second shell 14 which are movable towards each other, the longitudinal shell includes a third shell 15 and a fourth shell 16. An adjustable means 2 is provided in a jointing place between the first shell 13 and the second shell 14 and a jointing place between the third shell 15 and the fourth shell 16. The following, exemplarily, illustrates the latitudinal shell 11.

The adjustable means 2 includes a fixing shell 21 mounted on an outside of the first shell 13 and the second shell 14, a knob 22 positioned on the fixing shell 21 and an adjustable block fixed on an inside of the knob 22 and acts on the first shell 13 and the second shell 14. The inside of the adjustable means 2 has a bidirectional locking structure 3.

Figure 2:
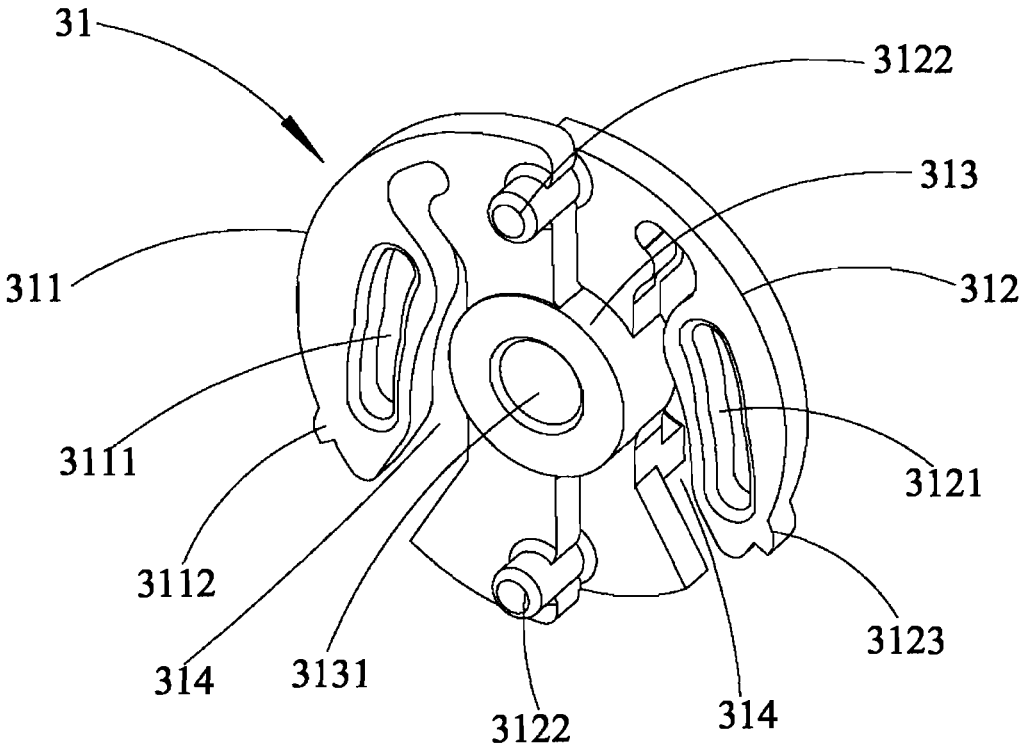
FIG. 2 is a perspective view of a ratchet wheel of the embodiment according to the present invention.
Figure 4:
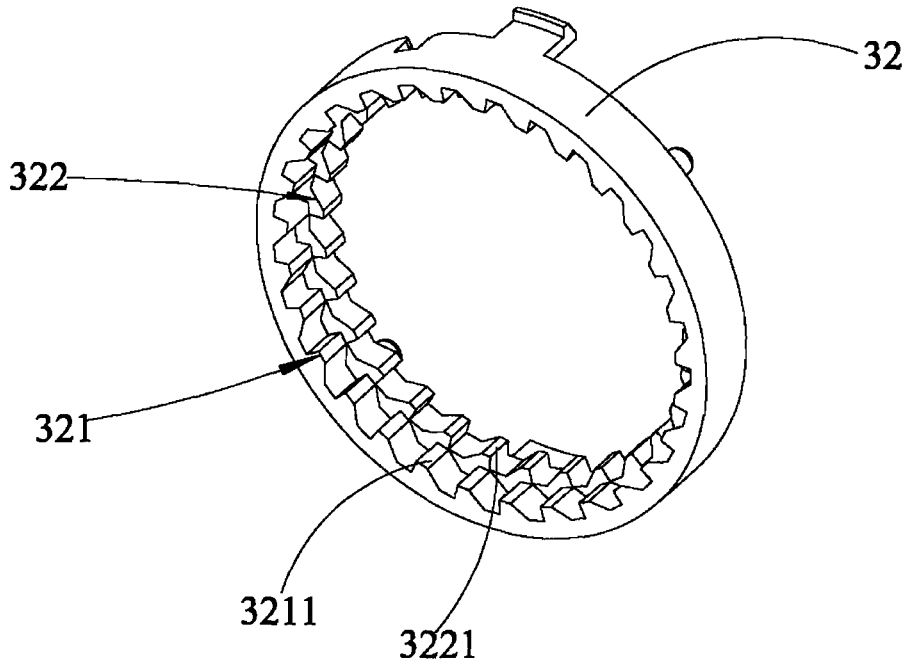
FIG. 4 is a perspective view of a ratchet wheel base of the embodiment according to the present invention.

As an embodiment of the present invention, referring to FIG. 2 and FIG. 4, the bidirectional locking structure 3 includes a ratchet wheel 31 and a ratchet wheel base 32, the ratchet wheel 31 has an upper ratchet buckle 311 and a lower ratchet buckle 312, the ratchet 32 is disposed around the ratchet wheel 31, the ratchet 32 has an upper ratchet ring 321 and a lower ratchet ring 322 respectively engaged with the upper ratchet buckle 311 and the lower ratchet buckle 312, the ratchet wheel 31 is fixed on an inside of the knob 22, and the adjustable block is fixed on an inside of the ratchet wheel 31.

Concretely, the ratchet wheel 31 includes a columnar body 313, the upper ratchet buckle 311 and the lower ratchet buckle 312. The upper ratchet buckle 311 and the lower ratchet buckle 312 are mounted at different levels along a shaft of the body 313, and both the upper ratchet buckle 311 and the lower ratchet buckle 312 are a semicircle which is symmetrically located along a radial axis of the body 313. The upper ratchet buckle 311 and the lower ratchet buckle 312 are provided symmetrically with first installation grooves 3111, 3121, the two first installation grooves 3111, 3121 is located at the same circle. The inside of the knob 22 has two symmetrical first fixing posts 221, during the course of installation the two first fixing posts 221 are respectively located in the two first installation grooves 3111, 3121. For the matching of the first installation grooves 3111, 3121 and the first fixing posts 221, the ratchet wheel 31 and ratchet wheel base 32 can be effectively pulled to disengage.

In detail, two second fixing posts 3122 is formed on the lower ratchet buckle 312 in a radial axis, the two second fixing posts 3122 resist against the edges of the upper ratchet buckle 311. The inside of the knob 22 has two second installation grooves 222, during the course of installation, the two second fixing posts respectively are slidingly arranged in the two second installation grooves 222. For the matching of the second installation grooves 222 and the second fixing posts 3122, the ratchet wheel 31 can be pulled to rotate effectively with the rotation of the knob 22.

As a preferred embodiment of the present invention, there is a hollow gap 314 defined between the upper ratchet buckle 311 and the body 313, there is also a hollow gap 314 defined between the lower ratchet buckle 312 and the body 313, and the gap 314 is curve-shaped. Advantageously, the upper ratchet buckle 311 and the lower ratchet buckle 312 can have better elasticity and can disengage with the ratchet wheel 32 more easily.

As an embodiment of the present invention, the ratchet wheel base 32 has a hollow ring-shaped structure, the outside of the inner hole of the ring-shaped structure has an upper ratchet ring 321, the inside of the upper ratchet ring 321 has a lower ratchet ring 322, the left tooth surface of the upper ratchet 3211 of the upper ratchet ring 321 is a right angle surface, the right tooth surface is a slope, the left tooth surface of the lower ratchet 3221 of the lower ratchet ring 322 is a slope, and the right tooth surface is a right angle surface. Referring to the FIG. 2, the outside edge of the upper ratchet buckle 311 of the ratchet wheel 31 has a first protrusion 3112, the outside edge of the lower ratchet buckle 312 has a second protrusion 3123, the inside surface of the first protrusion 3112 along a peripheral direction of the ratchet wheel 31 is a right angle surface, and the outside surface is a circle-arc surface. The inside surface of the second protrusion 3123 along a peripheral direction of the ratchet wheel is a right angle surface, and the outside surface is a circle-arc surface. When the ratchet wheel base 32 is disposed around the outside of the ratchet wheel 31, the right angle surface of the first protrusion 3112 engages with the left tooth surface of the upper ratchet 3211 of the upper ratchet ring 321, and the right angle surface of the second protrusion 3123 engages with the right tooth surface of the lower ratchet 3221 of the lower ratchet ring 322.

Figure 3:
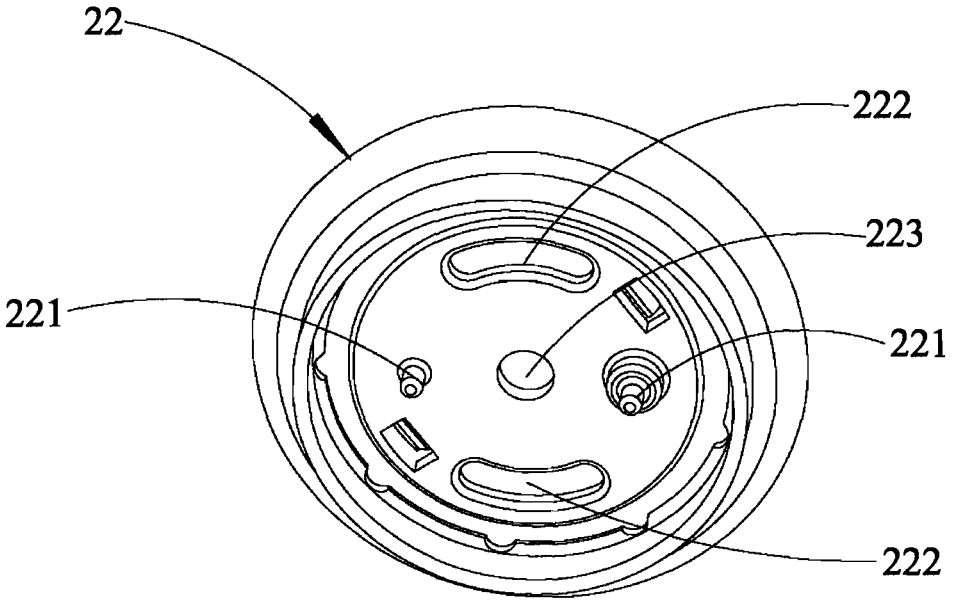
FIG. 3 is a perspective view of a knob of the embodiment according to the present invention.

As an embodiment of the present invention, the latitudinal shell 11 is jointed by a first shell 13 and a second shell 14, a first groove 131 and a second groove 141 overlapped with the first groove 131 are respectively defined at a jointing place of the first shell 13 and the second shell 14, the upper edge of the first groove 131 has an upper rack 1311, the lower edge of the second groove 141 has a lower rack 1411. In this embodiment, the adjustable block is a gear 23 extended through the first groove 131 and the second groove 141 and respectively engaged with the upper rack 1311 and the lower rack 1411. Referring to the FIG. 2 and FIG. 3, a center of the knob 22 has a fixing hole 223 therein, a center of the body 313 of the ratchet wheel 31 has a through-hole 3131 therein, one end of the drive shaft 231 of the gear 23 extends through the through-hole 2331, turns in the fixing hole 223 and is fixed by the fixing hole 223, the other end is fixed on the inside of the second shell 14. Thus, by using the drive shaft 231, the gear 23, the ratchet wheel 31 and the knob 22 are fixed together. In this embodiment, the first shell 13 and the second shell 14 can move against each other by using the upper rack 1311 and the lower rack 1411 to engage with the gear 23. However, the structure that adjusts the first shell 13 and the second shell 14 to move against each other is not limited in the aforementioned structure, it also can adopt other structures, for example, overlapping means and using the corresponding active buckle of the overlapping means to adjust.

As an embodiment of the present invention, a rack cover 24 fixed on the second shell 14 is formed on the jointing place between the first shell 13 and the second shell 14, the above-mentioned fixing shell 21 is located on the outside of the rack cover 24, the latitudinal length of the rack cover 24 is equal to the sum of the length of the first groove 131 and the second groove 141 when they are expanded completely, and the center of the rack cover 24 has a center hole 241 used for extension of the gear 23. Thus when the first shell 13 and the second shell 14 are expanded or contracted, both of the first groove 131 and the second groove 141 are covered completely by the rack cover 24, and the upper rack 1311 and the lower rack 1411 can be protected.

In this embodiment, during the assembly of the adjustable means 2 and bidirectional locking structure 3, the ratchet wheel base 32, ratchet wheel 31 and the knob 22 are assembled into the installation hole 211 of the fixing shell 21 from the front face thereof, the upper ratchet buckle 311 and the lower ratchet buckle 312 of the ratchet wheel 31 respectively engage with the upper ratchet ring 321 and the lower ratchet ring 322 of the ratchet wheel base 32. The fixing shell 21 already assembled is fixed on the latitudinal shell 11, so that the drive shaft 231 of the gear 23 installed on the latitudinal shell 11 can extend through the ratchet wheel 31 to be fixed in the fixing hole 223 of the knob 22.

Figure 5:
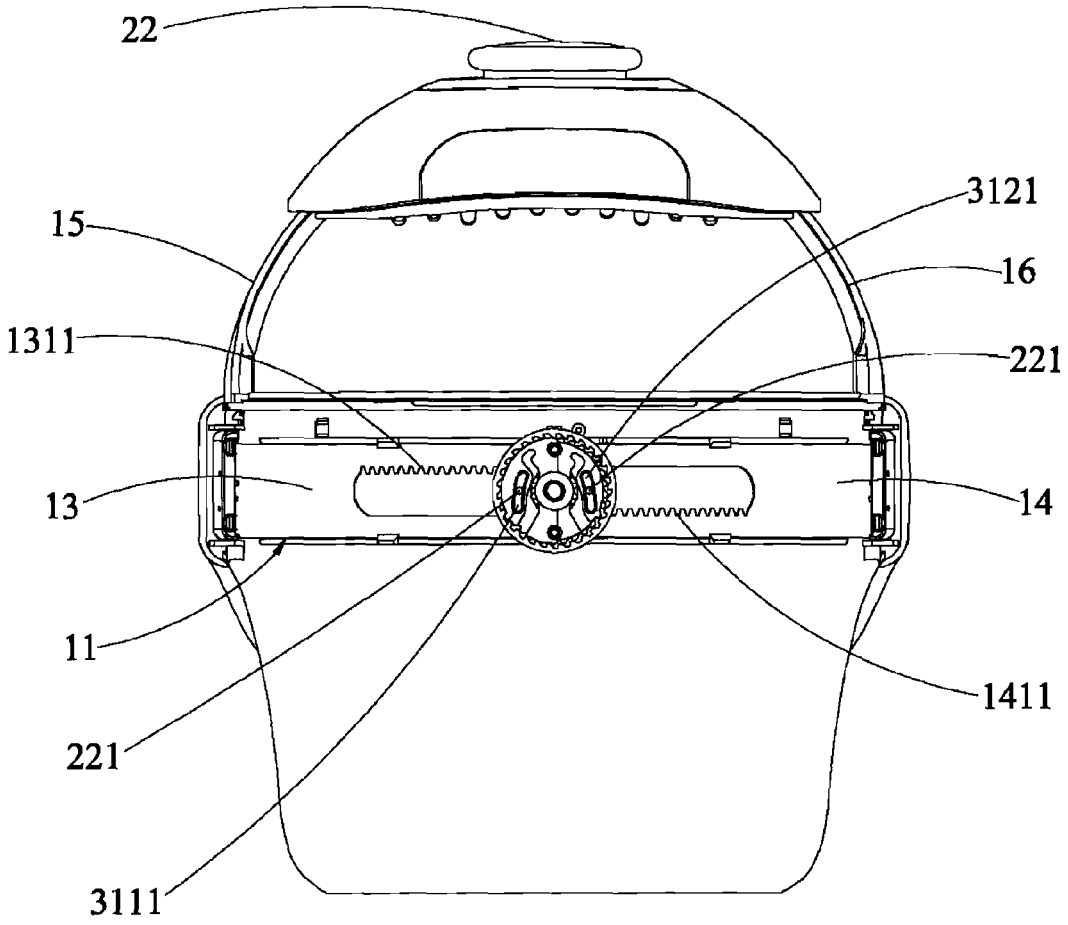
FIG. 5 is a schematic view of an adjustable helmet of the embodiment according to the present invention in a locking state.
Figure 6:
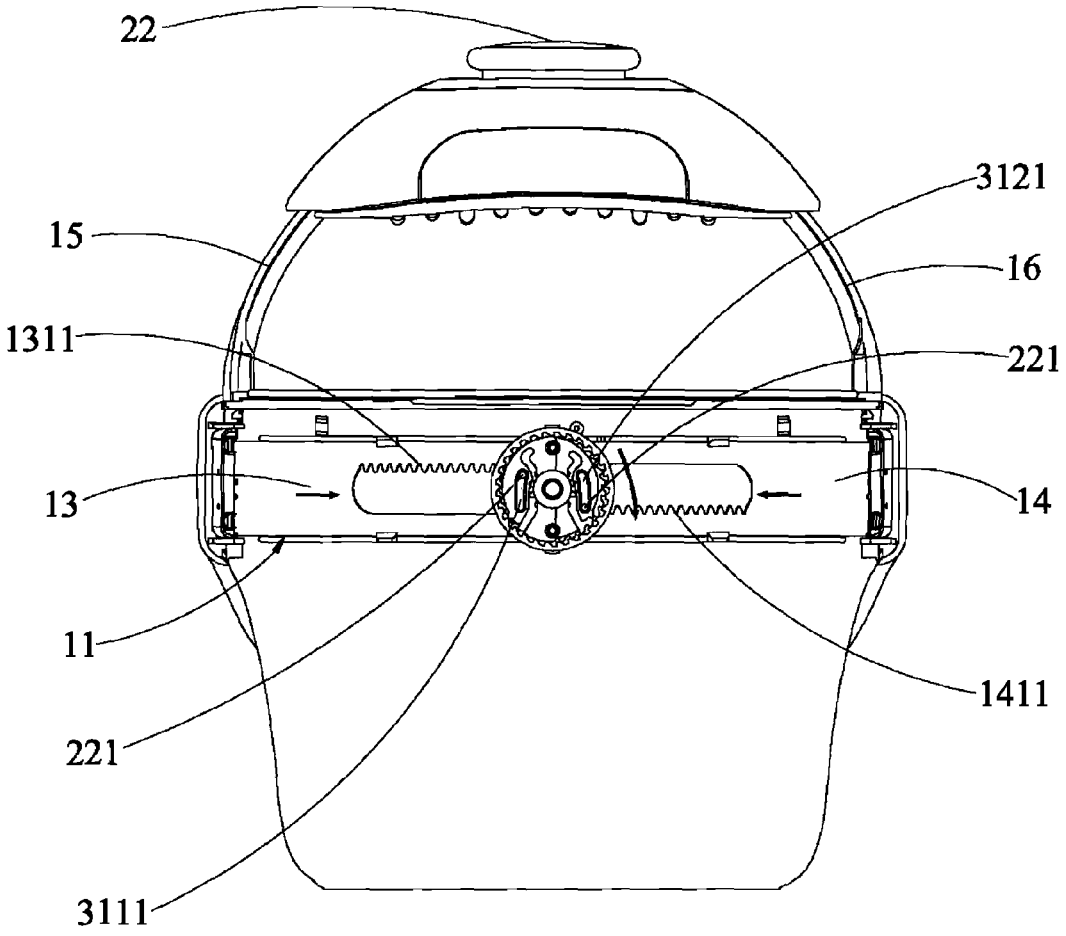
FIG. 6 is a schematic view of an adjustable helmet of the embodiment according to the present invention in a contracting state.
Figure 7:
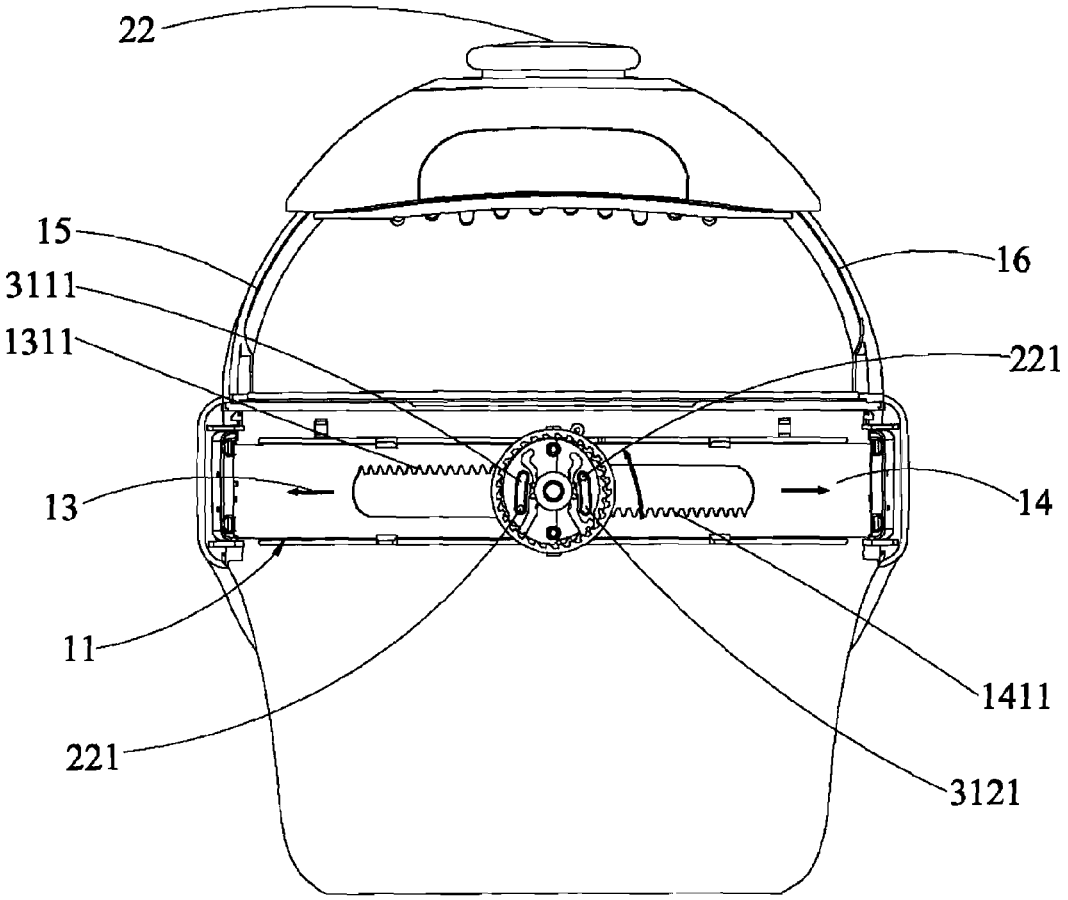
FIG. 7 is a schematic view of an adjustable helmet of the embodiment according to the present invention in an expanding state.

Referring to FIG. 5, in this embodiment when the knob 22 isn't rotated under a normal state of the adjustable helmet 1, the two symmetrical first fixing posts 221 of the knob 22 is respectively located in the center of the two first installation slots 3111, the upper ratchet buckle 311 and the lower ratchet buckle 312 of the ratchet wheel 31 respectively engage with the upper ratchet ring 321 and the lower ratchet 322 of the ratchet wheel base 32, the gear 23 can't move, the upper rack 1311 and the lower rack 1411 also can't engage with the gear 23 for transmission and displacement. Thus there isn't displacement between the first shell 13 and the second shell 14, the latitudinal shell 11 can't be contracted or expanded.

Referring to FIG. 2 to FIG. 4 and FIG. 6, when the knob 22 is clockwise turned, since the two second posts 3122 on the ratchet wheel 31 is respectively located in the two second installation slots 222, the ratchet wheel 31 is driven by the two second fixing posts 3122 to rotate with the rotation of the knob 22. During the rotation of the knob 22, the two first fixing posts 221 located inside of the knob 22 begins to rotate, wherein the first fixing post 221 in the first installation slot 3121 moves downwards, the first fixing post 221 in the first installation slot 3111 moves upwards. The lower ratchet buckle 312 of the ratchet wheel 31 and the lower ratchet ring 322 of the ratchet wheel base 32 engage with each other on the right side of the lower ratchet 3221. Due to the pull of the two first fixing posts 221, the right angle surface of the second protrusion 3123 of the lower ratchet buckle 312 disengages with the right angle tooth surface on the right side of the lower ratchet 3221 of the lower ratchet ring 322, the circle-arc surface of the first protrusion 3113 of the upper ratchet buckle 311 disengages with the slope of the upper ratchet ring 321 after a smooth transition during the clockwise rotation of the upper ratchet buckle 311. As a result, the ratchet wheel 31 can disengage completely with the ratchet wheel base 32 to thereby move freely, thus the gear 23 can be driven to move clockwise. At this time, the upper rack 1311 and the lower rack 1411 respectively engaging with the upper portion and the lower portion of the gear 23 move inwards, so that the first shell 13 and the second shell 14 contract inwards, namely the latitudinal length of the shell 11 is reduced. When the knob 22 stops rotating, the rotary first protrusion 3112 and second protrusion 3123 also stops rotating and locates on the upper ratchet 3211 and the lower ratchet 3221, the ratchet wheel 31 can't rotate without external forces, and the gear 23 also can't rotate. Advantageously, the upper rack 1311 and the lower rack 1411 can't move inwards or outwards, and the latitudinal shell 11 can be locked in an expanding or contracting direction.

Similarly, referring to FIG. 2 to FIG. 4 and FIG. 7, when the knob 22 is turned counterclockwise, the ratchet wheel 31 is driven by the two second posts 3122 to rotate with the rotation of the knob 22, the two first fixing posts 221 fixed inside of the knob 22 rotates counterclockwise during the rotation of the knob 22, wherein the first fixing post 221 in the first installation slot 3121 moves upwards, the first fixing post 221 in the first installation slot 3111 moves downwards, the engaging surface of the upper ratchet buckle 311 of the ratchet wheel 31 and the upper ratchet ring 321 of the ratchet wheel base 32 is on the left side of the upper ratchet 3211, so that the ratchet buckle 311 disengages with the upper ratchet 3211 of the upper ratchet ring 321 by the pull of the two first fixing posts 221, the circle-arc surface of the second protrusion 3123 of the lower ratchet buckle 312 disengages with the slope of the lower ratchet 3221 of the lower ratchet ring 322 after a smooth transition during the clockwise rotation of the lower ratchet buckle 312. Thus the ratchet wheel 31 can move without the limitation of the ratchet wheel base 32, the gear 23 can be driven to move counterclockwise, the upper rack 1311 and the lower rack 1411 engaged with the upper and the lower of the gear 23 move inwards respectively, so that the first shell 13 and the second shell 14 can expand outwards, namely that the latitudinal length of the shell 11 is increased. Similarly, when the knob 22 stops rotating, the rotary first protrusion 3112 and second protrusion 3123 also stop rotating and is located on the upper ratchet 3211 and the lower ratchet 3221, the ratchet wheel 31 can't rotate without external forces, and the gear 23 also can't rotate. Advantageously, the upper rack 1311 and the lower rack 1411 can't move inwards or outwards, and the latitudinal shell 11 can be locked in expanding or contracting direction.

In this embodiment, the longitudinal shell 12 also has the above-mentioned adjustable means 2 whose structure isn't described again. The both centers of the latitudinal shell 11 and the longitudinal shell 12 have the adjustable means 2, in this way, the adjustment in the latitudinal and the longitudinal direction can be implemented only by two adjusting means disposed on the adjustable helmet, namely the two knobs 22. Compared with the structure comprising three adjustable knobs in prior art, this embodiment has a simpler structure and easier operation.

The invention also provides a head massager (not shown), including the adjustable helmet 1 and a massager mounted on the adjustable helmet 1. When the adjustable helmet 1 is applied to a head massager, just two knobs 22 are needed in order to adjust the size of the head massager, so that the helmet can't be contracted or expanded arbitrarily after the helmet is adjusted and locked in bi-direction, and the massager will be easier to use.

The above-mentioned is only the preferred embodiments of the present invention, but places no limit to the invention. Therefore, any modification, equivalent replacement and improvement etc on the basis of the spirit and principle of invention shall be within the protective scope of the present invention.

The invention claimed is:

1. An adjustable helmet, comprising:

a ring-shaped latitudinal shell, and a longitudinal shell connected across the latitudinal shell, wherein at least one of the longitudinal shell and the latitudinal shell has an adjustable mechanism which is able to adjust the length of the shell, wherein an inside of the adjustable mechanism has a bidirectional locking structure, wherein the at least one of the latitudinal shell and the longitudinal shell includes two separate straps, the two separate straps are movable toward each other through the adjustable mechanism, wherein the bidirectional locking structure comprises a ratchet wheel and a ratchet wheel base engaged with the ratchet wheel, and wherein the ratchet wheel comprises a first ratchet buckle and a second ratchet buckle having a direction opposite to that of the first ratchet buckle, the ratchet wheel base is disposed around the ratchet wheel, the ratchet wheel base has a first ratchet ring and a second ratchet ring respectively matched with the first ratchet buckle and the second ratchet buckle.

2. The adjustable helmet of claim 1, wherein the ratchet wheel comprises a body, the first ratchet buckle and the second ratchet buckle are symmetrically provided along a radial direction of the body, the first ratchet buckle and the second ratchet buckle are provided one by one along the axial direction of the body, two symmetrical first installation slots mounted on the same circle are respectively defined in the first ratchet buckle and the second ratchet buckle, and the two first installation slots are adapted to contain two first fixing posts in an inside of a knob connected with the ratchet wheel.

3. The adjustable helmet of claim 2, wherein second fixing posts are formed on the second ratchet buckle, the second fixing posts resist against an edge of the first ratchet buckle, the inside of the knob has a second corresponding installation slots for the second fixing posts being slidable therein when the second fixing posts are rotated.

4. The adjustable helmet of claim 1, wherein an outside edge of the first ratchet buckle has a first protrusion, an outside edge of the second ratchet buckle has a second protrusion, both inside surfaces of the first protrusion and the second protrusion along the circumferential direction of the ratchet wheel are right-angled surfaces, and outside surfaces of the first protrusion and the second protrusion along the circumferential direction of the ratchet wheel are circle-arc surfaces.

5. The adjustable helmet of claim 2, wherein a first hollow gap between the first ratchet buckle and the body, and a second hollow gap between the second ratchet buckle and the body are provided, and the first and second hollow gaps are curve-shaped.

6. The adjustable helmet of claim 1, wherein the adjustable mechanism comprises a fixing shell outside of the latitudinal shell or longitudinal shell, a knob installed on the fixing shell and an adjustable block installed on the latitudinal shell or longitudinal shell, wherein the ratchet wheel is fixed on an inside of the knob and the adjustable block is fixed on an inside of the ratchet wheel.

7. The adjustable helmet of claim 1, wherein at least one of the latitudinal shell and longitudinal shell has a first groove and a second groove overlapped with each other, an upper edge of the first groove has an upper rack, a lower edge of the second groove has a lower rack, the adjustable mechanism further comprises an adjustable block installed on the at least one of the latitudinal shell and longitudinal shell, the adjustable block is a gear which is extendable through the first groove and the second groove, and engages with the upper rack and the lower rack respectively.

8. The adjustable helmet of claim 2, wherein an outside edge of the first ratchet buckle has a first protrusion, an outside edge of the second ratchet buckle has a second protrusion, both inside surfaces of the first protrusion and the second protrusion along the circumferential direction of the ratchet wheel are right angle surfaces, and outside surfaces of the first protrusion and the second protrusion along the circumferential direction of the ratchet wheel are circle-arc surfaces.

9. The adjustable helmet of claim 3, wherein an outside edge of the first ratchet buckle has a first protrusion, an outside edge of the second ratchet buckle has a second protrusion, both inside surfaces of the first protrusion and the second protrusion along the circumferential direction of the ratchet wheel are right angle surfaces, and the outside surfaces of the first protrusion and the second protrusion along the circumferential direction of the ratchet wheel are circle-arc surfaces.

10. The adjustable helmet of claim 3, wherein a first hollow gap between the first ratchet buckle and the body, and a second hollow gap between the second ratchet buckle and the body are provided, and the first and second hollow gaps are curve-shaped.

11. The adjustable helmet of claim 6, wherein at least one of the latitudinal shell or longitudinal shell has a first groove and a second groove overlapped with each other, an upper edge of the first groove has an upper rack, a lower edge of the second groove has a lower rack, the adjustable block is a gear which is extendable through the first groove and the second groove, and engages with the upper rack and the lower rack respectively.

12. A massager comprising, a helmet; and a massage unit mounted on the helmet, wherein the helmet is the adjustable helmet of claim 1.

13. The massager of claim 12, wherein the ratchet wheel comprises a body, the first ratchet buckle and the second ratchet buckle are symmetrically provided along a radial direction of the body, the first ratchet buckle and the second ratchet buckle are provided one by one along the axial direction of the body, two symmetrical first installation slots mounted on the same circle are respectively defined in the first ratchet buckle and the second ratchet buckle, and the two first installation slots are adapted to contain two first fixing posts in an inside of a knob connected with the ratchet wheel.

14. The massager of claim 12, wherein second fixing posts are formed on the second ratchet buckle, the second fixing posts resist against an edge of the first ratchet buckle, the inside of the knob has a second corresponding installation slots for the second fixing posts being slidable therein when the second fixing posts are rotated.

15. The massager of claim 12, wherein an outside edge of the first ratchet buckle has a first protrusion, an outside edge of the second ratchet buckle has a second protrusion, both inside surfaces of the first protrusion and the second protrusion along the circumferential direction of the ratchet wheel are right-angle surfaces, and outside surfaces of the first protrusion and the second protrusion along the circumferential direction of the ratchet wheel are circle-arc surfaces.

16. The massager of claim 13, wherein a hollow gap between the first ratchet buckle and the body, and a second hollow gap between the second ratchet buckle and the body are provided, and the first and second hollow gaps are curve-shaped.

17. The massager of claim 12, wherein the adjustable mechanism comprises a fixing shell outside of the latitudinal shell or longitudinal shell, a knob installed on the fixing shell and an adjustable block installed on the latitudinal shell or longitudinal shell, wherein the ratchet wheel is fixed on an inside of the knob and the adjustable block is fixed on an inside of the ratchet wheel.

18. The massager of claim 12, wherein at least one of the latitudinal shell and longitudinal shell has a first groove and a second groove overlapped with each other, an upper edge of the first groove has an upper rack, a lower edge of the second groove has a lower rack, the adjustable mechanism further comprises an adjustable block installed on the at least one of the latitudinal shell and longitudinal shell, the adjustable block is a gear which is extendable through the first groove and the second groove, and engages with the upper rack and the lower rack respectively.

19. The massager of claim 12, wherein an outside edge of the first ratchet buckle has a first protrusion, an outside edge of the second ratchet buckle has a second protrusion, both inside surfaces of the first protrusion and the second protrusion along the circumferential direction of the ratchet wheel are right angle surfaces, and outside surfaces of the first protrusion and the second protrusion along the circumferential direction of the ratchet wheel are circle-arc surfaces.

20. The massager of claim 12, wherein an outside edge of the first ratchet buckle has a first protrusion, an outside edge of the second ratchet buckle has a second protrusion, both inside surfaces of the first protrusion and the second protrusion along the circumferential direction of the ratchet wheel are right angle surfaces, and the outside surfaces of the first protrusion and the second protrusion along the circumferential direction of the ratchet wheel are circle-arc surfaces.

* * * * *